US007599505B2

(12) United States Patent
Akino

(10) Patent No.: US 7,599,505 B2
(45) Date of Patent: Oct. 6, 2009

(54) CONDENSER MICROPHONE

(75) Inventor: Hiroshi Akino, Machida (JP)

(73) Assignee: Kabushiki Kaisha Audio-Technica, Machida-Shi, Tokyo (JP)

( * ) Notice: Subject to any disclaimer, the term of this patent is extended or adjusted under 35 U.S.C. 154(b) by 917 days.

(21) Appl. No.: 11/118,408

(22) Filed: May 2, 2005

(65) Prior Publication Data

US 2005/0254670 A1 Nov. 17, 2005

(30) Foreign Application Priority Data

May 11, 2004 (JP) ..... 2004-140579

(51) Int. Cl.
*H04R 3/00* (2006.01)

(52) U.S. Cl. ..... 381/113; 381/355; 381/369; 381/171; 381/177; 381/363

(58) Field of Classification Search ..... 381/174, 381/369, 190–192, 355, 361–362, 178, 363, 381/368, 111–115, 122, 171, 177
See application file for complete search history.

(56) References Cited

U.S. PATENT DOCUMENTS

| | | | | |
|---|---|---|---|---|
| 4,567,608 | A * | 1/1986 | Watson et al. | 381/122 |
| 7,330,559 | B2 * | 2/2008 | Akino | 381/363 |
| 7,483,542 | B2 * | 1/2009 | Akino et al. | 381/189 |
| 2005/0254670 | A1 * | 11/2005 | Akino | 381/113 |

* cited by examiner

*Primary Examiner*—Vivian Chin
*Assistant Examiner*—Disler Paul
(74) *Attorney, Agent, or Firm*—Manabu Kanesaka

(57) ABSTRACT

In a condenser microphone in which a microphone capsule and an audio output section are connected to each other via a microphone cord, strong electromagnetic waves generated by a cellular phone etc. are prevented from being transmitted by the microphone cord and intruding into the audio output section. In a condenser microphone in which a microphone capsule 10 and an audio output section 20, in which a circuit board 23 including an audio output circuit is housed in a shield case 210, are connected to each other via a microphone cord 30, of the circuit board 23, a terminal 231 connected to the microphone cord 30 is arranged on the outside of the shield case 210.

4 Claims, 2 Drawing Sheets

CONDENSER MICROPHONE

RELATED APPLICATIONS

The present application is based on, and claims priority from, Japanese Application Number 2004-140579, filed May 11, 2004, the disclosure of which is hereby incorporated by reference herein in its entirety.

TECHNICAL FIELD

The present invention relates to a condenser microphone in which a microphone capsule and an audio output section are connected to each other by a dedicated microphone cord. More particularly, it relates to a technique for preventing electromagnetic waves generated by a cellular phone etc. from being transmitted by the microphone cord and intruding into the audio output section.

BACKGROUND ART

For a gooseneck microphone for conference, a tie clip microphone used by being attached to clothes etc., and the like of the condenser microphones, as shown in FIG. 3, a microphone capsule 10 and an audio output section 20 are separated from each other and are connected to each other by a dedicated microphone cord 30.

In the microphone capsule 10, a condenser microphone unit including a diaphragm and a backplate and an impedance converter therefor, for example, a field effect transistor (FET) are housed (both elements are not shown). The audio output section 20 is provided with a cylindrical shield case 21 made of a conductive material (for example, brass alloy). In the shield case 21, an output connector 22 and a circuit board 23 are housed.

The condenser microphone usually uses a three-pin type output connector specified in EIAJ RC5236 "Audio latch lock round type connector". The condenser microphone is connected to a phantom power source via a balanced shielded cable for phantom power source, not shown.

The circuit board 23 is provided with an audio output circuit, not shown, including a transformer, a low cut filter circuit, an amplifier circuit etc. As the microphone cord 30, a two-core shielded cable is used. One end of the microphone cord 30 is connected to the impedance converter in the microphone capsule 10, and the other end thereof is pulled into the shield case 21 and is connected by soldering to a predetermined terminal (terminal of audio output circuit) of the circuit board 23.

In a portion in which the microphone cord 30 is pulled into the shield case 21, a knot 31 for preventing the cord 30 from coming off is made, and on the cord pulling-in side of the shield case 21, a cord bush 24 made of, for example, a rubber material is fitted and screwed in. In the case of the gooseneck microphone, the microphone cord 30 is inserted into a flexible shaft, not shown.

The two-core shielded cable used as the microphone cord 30 includes a power line for supplying power to the condenser microphone unit in the microphone capsule 10, a signal line for sending an audio signal generated by the impedance converter to the audio output circuit of the circuit board 23, and a shield line for electrostatically shielding and grounding the power line and signal line, and is vulnerable to (liable to be affected by) noise from the outside because the audio signal is transmitted imbalancedly.

In addition, in the conventional example, since a part of microphone cord 30 is pulled in the shield case 21, if strong electromagnetic waves are applied to the microphone cord 30, the electromagnetic waves intrude into the shield case 21, by which noise is sometimes generated.

In recent years, cellular phones have come into wide use. In the case where a cellular phone is used in the immediate vicinity of a microphone, the microphone receives considerably strong electromagnetic waves (for example, in the range of several centimeters to several tens centimeters, field intensity reaching several ten thousands of intensity of field generated in the city by commercial electric waves), so that measures against cellular phones are a pressing need in the field of microphone.

As one method for answering the need, a technique in which, for example, in a gun microphone in which the microphone unit is housed in a housing cylinder consisting of a conductor, the microphone unit is connected (grounded) to the housing cylinder consisting of a conductor at the shortest distance has been proposed in Patent Document 1 (Japanese Patent Application Publication No. 2004-103591).

However, although being effective for the gun microphone or the like, this method cannot be applied to a microphone in which, as in the conventional example, the microphone capsule and the audio output section are separated from each other and are connected to each other via the microphone cord.

SUMMARY OF THE INVENTION

Accordingly, a problem to be solved by the present invention is to prevent strong electromagnetic waves generated by a cellular phone etc. from being transmitted by a dedicated microphone cord and intruding into an audio output section in a condenser microphone in which a microphone capsule and the audio output section are connected to each other via the microphone cord.

To solve the above problem, the present invention provides a condenser microphone comprising a microphone capsule including a condenser microphone unit and an impedance converter therefor; an audio output section in which a circuit board including an audio output circuit is housed in a shield case; and a microphone cord which is laid between the microphone capsule and the audio output section, one end thereof being connected to the impedance converter, and the other end thereof being connected to a terminal of the circuit board, wherein, of the circuit board, only the terminal connected to the microphone cord is pulled out of the shield case.

In the present invention, it is preferable that the shield case consist of a cylindrical body one end of which is provided with an output connector and the other end of which is closed by an end wall having a slit hole for pulling out the terminal, and a cord bush provided with a means for preventing the microphone cord from coming off be mounted on the other end side of the shield case.

According to the present invention, since the microphone cord is connected to the terminal pulled out of the shield case for the circuit board, strong electromagnetic waves applied to the microphone cord do not intrude into the shield case, and flow along the outer surface of the shield case. Therefore, even if a cellular phone is used in the immediate vicinity of the microphone, noise caused by the strong electromagnetic waves is prevented from being generated.

DETAILED DESCRIPTION

Figure 1:
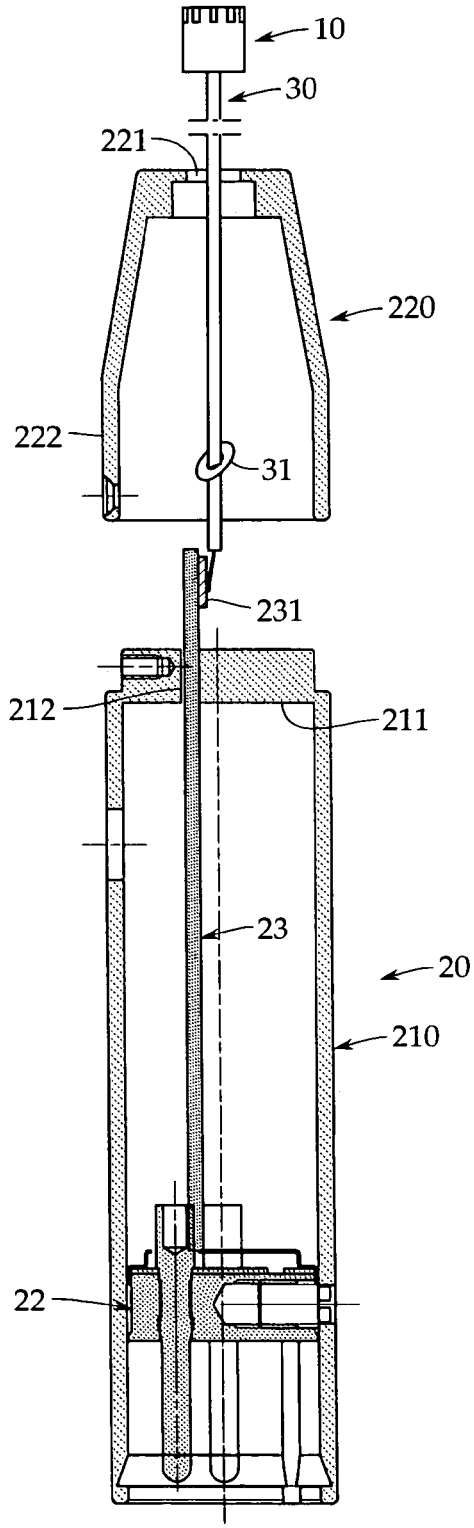
FIG. 1 is a general configuration view showing, in a partial cross section, a state in which a microphone capsule and an audio output section, which are included in a condenser microphone in accordance with the present invention, are connected to each other via a microphone cord.
Figure 2:
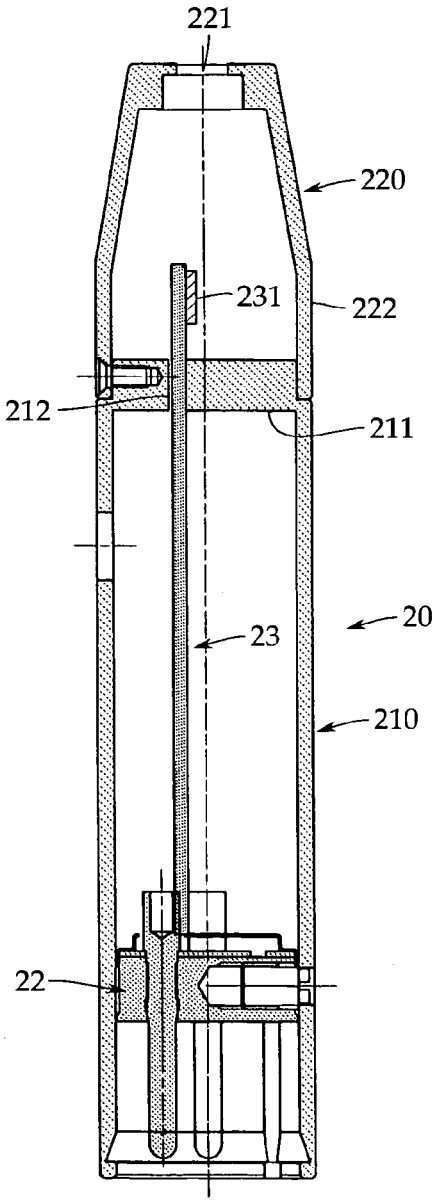
FIG. 2 is a sectional view showing only the audio output section shown in FIG. 1.
Figure 3:
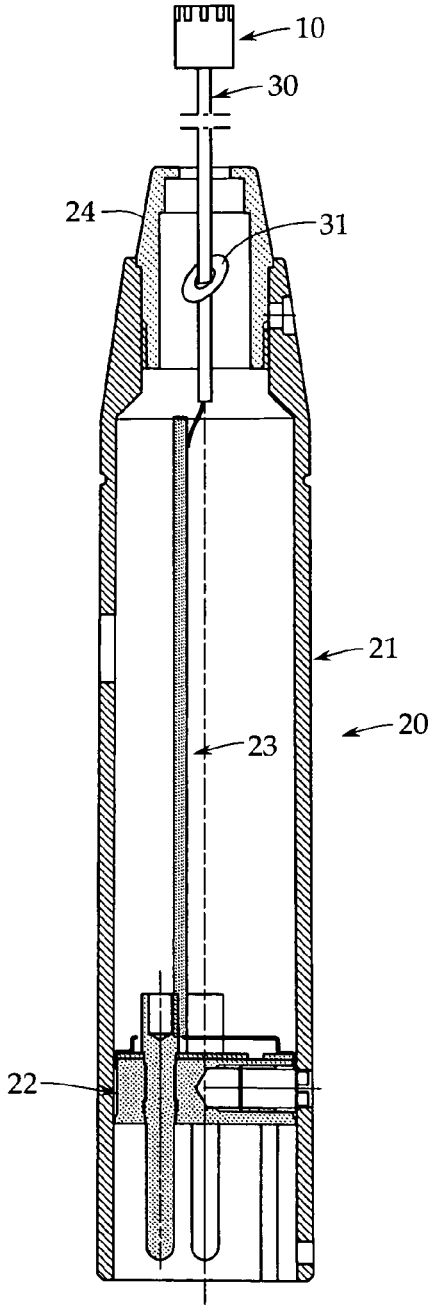
PRIOR ART FIG. 3
FIG. 3 is a general schematic view showing, in a partial cross section, a conventional example.

An embodiment of the present invention will now be described with reference to FIGS. 1 and 2. FIG. 1 is a schematic view showing a state in which a microphone capsule and an audio output section, which are included in a condenser microphone in accordance with the present invention, are connected to each other via a microphone cord. In FIG. 1, the audio output section is shown in a broken sectional view. FIG. 2 is a sectional view showing only the audio output section, which is an essential portion of the present invention. In FIGS. 1 and 2, the same reference numerals are applied to elements that are the same or regarded as the same as the elements in the conventional example explained before with reference to FIG. 3.

The condenser microphone in accordance with the present invention is a microphone in which a microphone capsule 10 and an audio output section 20 are separated from each other and these elements are connected to each other via a microphone cord 30. Generally, this microphone is used as, for example, a gooseneck microphone or a tie clip microphone.

The microphone capsule 10 may be configured so as to include a condenser microphone unit, in which a diaphragm and a backplate are arranged opposedly, and an impedance converter therefor (both elements are not shown). The condenser microphone unit may be of either an electret type or a non-electret type. Also, as the impedance converter, an FET may be used.

The audio output section 20 is provided with a cylindrical shield case 210 made of a conductive metallic material such as a brass alloy. On one end side of the shield case 210, a three-pin type output connector 22 is mounted, and a balanced shielded cable for phantom power source, not shown, is connected to this output connector 22.

Also, in the shield case 210, a circuit board 23 having a transformer, a low cut filter circuit, an amplifier circuit (these elements are not shown) etc. is housed in a state of being electrically connected to the output connector 22.

The circuit board 23 is provided with a terminal 231 for connecting the microphone cord 30 to an end portion opposite to the output connector 22. The terminal 231 is formed as a soldering land (connection electrode) connected to a predetermined circuit part in the audio output circuit via a laid-out wiring, not shown. In the present invention, the terminal 231 is arranged on the outside of the shield case 210.

That is to say, the other end side (side opposite to the output connector) of the shield case 210 is closed by an end wall 211, and a slit hole 212 is formed in the end wall 211. A part including the terminal 231 of the circuit board 23 is pulled out of the shield case 210 through the slit hole 212.

The end wall 211 is also made of a conductive metallic material, and is preferably formed integrally as a part of the shield case 210. However, the end wall 211 may be installed at the end of the shield case 210 as a separate lid member. A gap between the slit hole 212 and the pull-out portion of the circuit board 23 is preferably as narrow as possible to prevent electromagnetic waves from intruding into the shield case 210.

As in the conventional example explained before, as the microphone cord 30, a two-core shielded cable may be used which includes a power line for supplying power to the condenser microphone unit in the microphone capsule 10, a signal line for sending an audio signal generated by the impedance converter to the audio output circuit of the circuit board 23, and a shield line for electrostatically shielding and grounding the power line and signal line.

In the present invention, the microphone cord 30 is connected to the terminal 231 of the circuit board 23, which is arranged on the outside of the shield case 210, by soldering, for example. To protect the connecting portion, a cord bush 220 is installed to the end wall 211 of the shield case 210.

The material for the cord bush 220 may be either a conductive metallic material or an electrical insulating elastic material such as rubber. In this example, the cord bush 220 is formed as a conical sleeve formed with a cord insertion hole 221 in the top portion thereof, and a skirt portion 222 thereof is screw-mounted on the end wall 211 of the shield case 210.

In order to connect the microphone cord 30 to the terminal 231 of the circuit board 23, an end portion of the microphone cord 30 is inserted through the cord insertion hole 221 in the cord bush 220, and a knot 31, which is bigger than the cord insertion hole 221, for preventing the cord 30 from coming off is made. Thereafter, the terminal 231 is soldered, and the cord bush 220 is screw-mounted on the end wall 211 of the shield case 210. In place of soldering, for example, a pin clip may be used to connect the microphone cord 30 to the terminal 231.

According to this configuration, for example, even if a cellular phone is used in the immediate vicinity of the microphone and hence strong electromagnetic waves thereof are applied to the microphone cord 30, the electromagnetic waves do not intrude into the shield case 210, and flow into a grounding circuit, not shown, after passing through the outer surface of the shield case 210, so that noise is prevented from being generated.

The above is an explanation of an embodiment of the present invention given with reference to FIGS. 1 and 2. The present invention is not limited to this embodiment. For example, although the phantom power source is used in this embodiment, a battery may be used as the power source. The audio output section 20 is the same as what is called a power module. The shield case 210 may be formed in a box shape, not a cylindrical shape.

Also, a part of the circuit board 23 for pulling the terminal 231 out of the shield case 210 is inserted through the slit hole 212 in the end wall 211 in this embodiment. However, the configuration may be such that, for example, the terminal 231 is arranged along the side surface of the end wall 211, and the terminal 231 is connected to the circuit board 23 via a suitable wiring inserted into the shield case 210.

The invention claimed is:

1. A condenser microphone comprising:

a microphone capsule having a condenser microphone unit and an impedance converter thereof;

a microphone cord having one end connected to the impedance converter, and an other end; and an audio output section formed separately from the microphone capsule and including a shield case having a cylindrical body and an end wall with a slit hole therein; a circuit board having an audio output circuit with a terminal at one end thereof, said circuit board being arranged such that only the terminal passes through the slit hole of the end wall to be located outside the shield case and connected to the other end of the microphone cord, and the audio output circuit except for the terminal is housed in the shield case; and a cord bush mounted on the shield case to cover the end wall and the terminal, and having means for preventing the microphone cord from coming off.

2. The condenser microphone according to claim 1, wherein the circuit board has a pull-out portion for the terminal, said pull-out portion and the slit hole of the end wall being formed, when assembled together, to have a narrow gap therebetween to prevent electromagnetic waves from intruding into the shield case.

3. The condenser microphone according to claim 2, further comprising an output connector attached to the shield case at a side opposite to the end wall.

4. The condenser microphone according to claim 3, wherein the shield case including the end wall is formed of an electro conductive material so that the end wall forms a part of the shield case.

* * * * *